United States Patent [19]

Hayakawa

[11] 4,384,390

[45] May 24, 1983

[54] BUCKLE FOR BELT

[75] Inventor: Shinichi Hayakawa, Seki, Japan

[73] Assignee: Hayakawa Industry Co., Ltd., Japan

[21] Appl. No.: 194,073

[22] Filed: Oct. 6, 1980

[30] Foreign Application Priority Data

Oct. 20, 1979 [JP] Japan ..... 54-145228[U]
Jul. 28, 1980 [JP] Japan ..... 55-106655[U]
Jul. 29, 1980 [JP] Japan ..... 55-107105[U]

[51] Int. Cl.[3] ..... A44B 11/00

[52] U.S. Cl. ..... 24/163 R; 224/163; 24/163 K; D2/380

[58] Field of Search ..... 7/151, 152; 24/163 R, 24/163 K; 30/151; 224/163, 232, 904; D2/380; 150/34

[56] References Cited

U.S. PATENT DOCUMENTS 1,599,920 9/1922 Pryor ..... 224/163
3,461,469 8/1969 Morrison ..... 7/152

*Primary Examiner*—Gene Mancene

*Assistant Examiner*—James Hakomaki

*Attorney, Agent, or Firm*—Leydig, Voit, Osann, Mayer & Holt, Ltd.

[57] ABSTRACT

A belt buckle to which a plate-like tool can be attached. The belt buckle is constructed of a base plate and a fitting case covering the front side of the base plate so that a fitting space for fitting the tool therein is formed inbetween. In the fitting space, on the other hand, there is mounted a locking plate for holding the tool under its fitted condition. This locking plate is constructed of a retaining portion, which is made engageable with the engagement opening of the tool, and a pressure portion for pushing the back of the tool under its engaging condition to the front. When the tool is to be taken out of the fitting space, a finger is inserted through the aperture of the fitting case thereby to inwardly push the retaining portion of the locking plate so that the tool is extracted under the condition in which the retaining portion is disengaged to the back from the engagement opening of the tool.

8 Claims, 13 Drawing Figures

FIG. 2
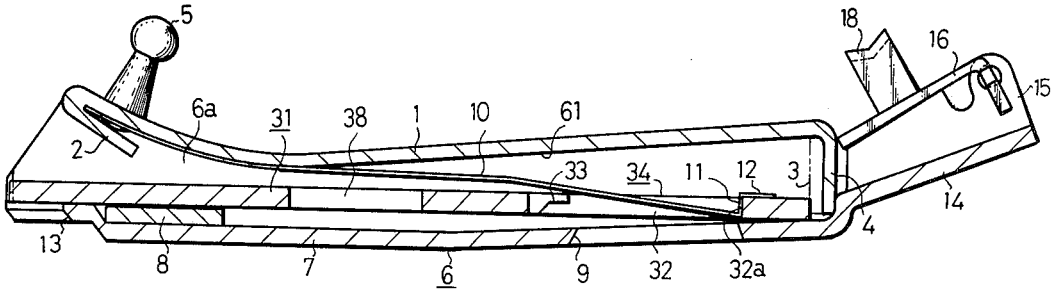
FIG. 3
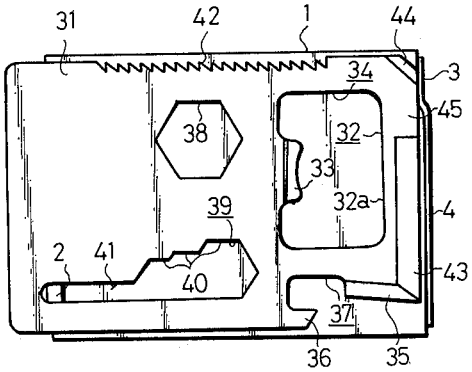
FIG. 5
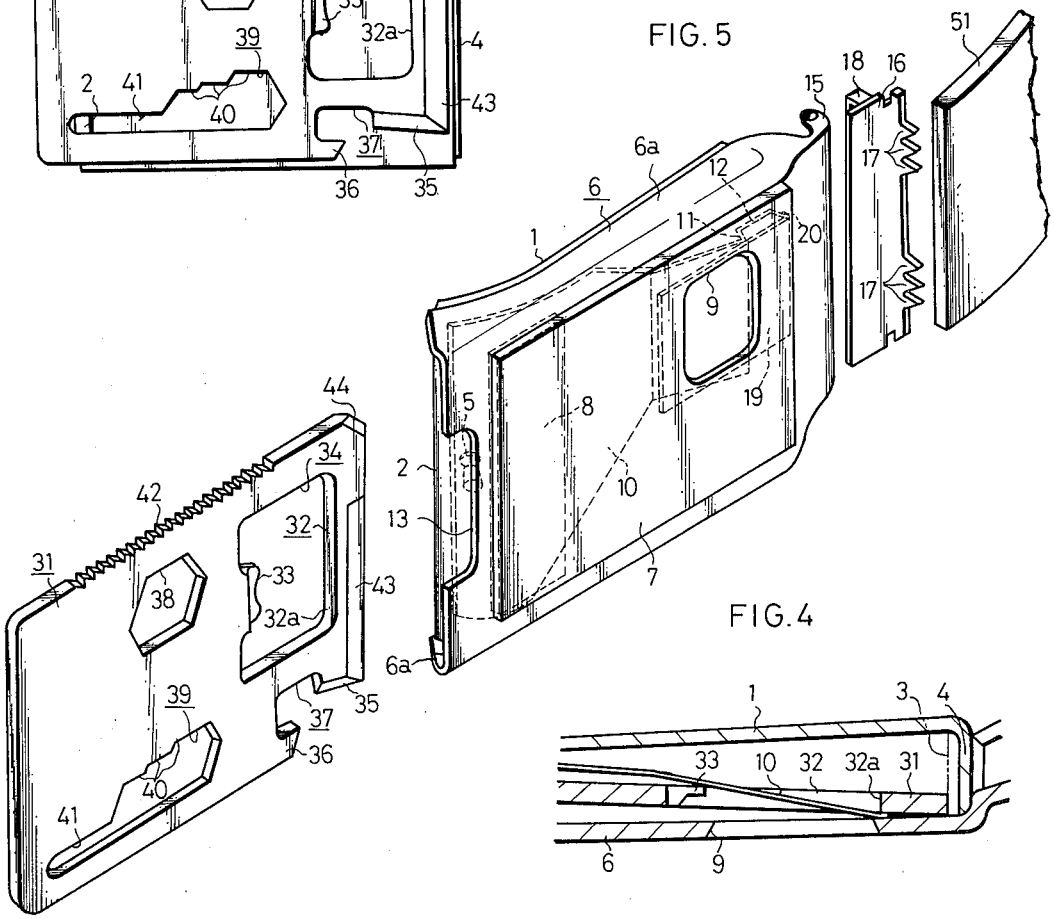
FIG. 4

BUCKLE FOR BELT

BACKGROUND OF THE INVENTION

The present invention relates to a belt buckle to which a plate-like tool such as a multi-purpose tool can be attached.

SUMMARY OF THE INVENTION

An object of the present invention is to provide a belt buckle to and from which a tool can be attached and detached with ease while the belt is being worn.

Another object of the present invention is to provide a belt buckle of the type, in which the construction of a locking mechanism for locking the tool in the buckle is simplified and in which the locking and releasing operations of the tool can be ensured.

Still another object of the present invention is to provide a belt buckle which can prevent a finger from getting hurt by the tool when the tool is attached to and detached from the buckle.

A further object of the present invention is to provide a belt buckle which can prevent the blade of a cutter from being nicked when the tool is inserted into the buckle even in case the tool is formed at its leading end with the cutter.

Other objects of the present invention will become apparent from the understanding of the modes of example, as will be described hereinafter, and will be clearly defined in the appended claims. Numeral advantages which are left untouched in the specification will occur to those skilled in the art if the present invention is put into practice.

BRIEF DESCRIPTION OF THE DRAWINGS

FIG. 2 is an enlarged sectional view showing a multi-purpose tool under the condition in which the tool is fitted in the buckle according to the first embodiment;

FIG. 3 is a front elevation showing the engagement condition between the stopper of the buckle of the first embodiment and the abutment portion of the multi-purpose tool;

FIG. 4 is a partially sectional view showing the condition in which the leading end of a locking plate is forced into the front side of the multi-purpose tool;

FIG. 5 is a perspective view showing a buckle according to a second embodiment of the present invention;

DESCRIPTION OF THE PREFERRED EMBODIMENTS

Figure 1:
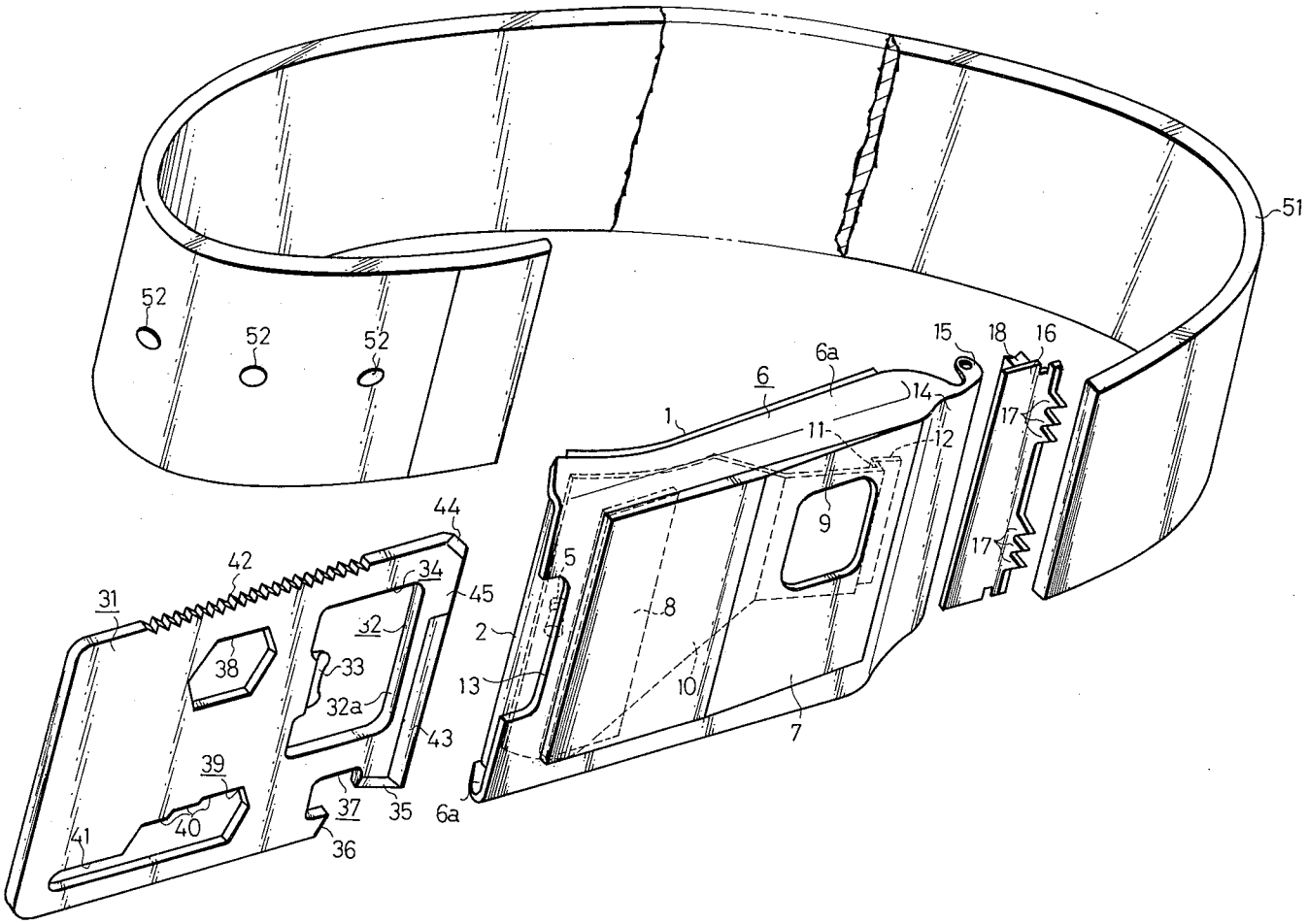
FIG. 1 is a perspective view showing a buckle exemplifying a first embodiment of the present invention together with a belt.
Figure 6:
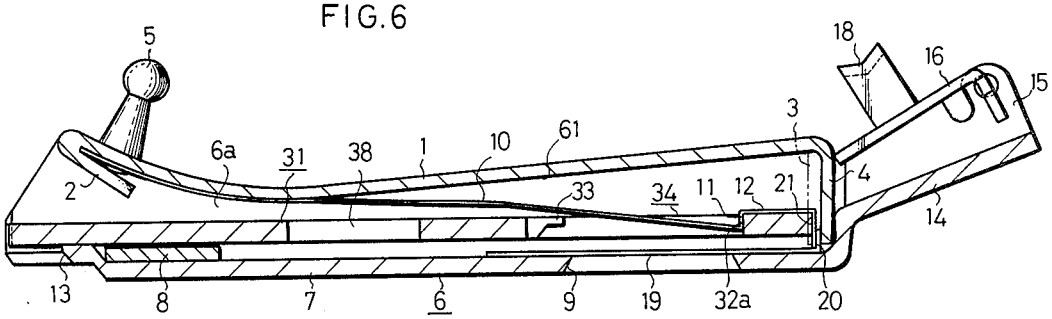
FIG. 6 is an enlarged sectional view showing the multi-purpose tool under the condition in which the tool is fitted in the buckle according to the second embodiment.

A first embodiment exemplifying the present invention will be described hereinafter with reference to FIGS. 1 to 4. Indicated at reference numeral 1 is a buckle base plate which has a generally rectangular shape in its front view and which has its left end portion gently and slightly curved backward and its left end edge bent to the front, as shown in FIG. 2, to form a bent portion 2. Indicated at numeral 3 is a stopper which is formed at the upper end portion of the base plate 1 by bending the righthand edge of the base plate 1 at a right angle to the front. Indicated at numeral 4 is a relief which is formed at the lower portion of the stopper 3. Indicated at numeral 5 is a hook pin which is formed to protrude from the back of the lefthand portion of the base plate 1 and which has its base end caulked to the base plate 1. The hook pin 5 is retained in one of the belt holes 52 formed at the leading end portion of a belt 51 when this belt 51 is worn on a human body.

Indicated at numeral 6 is a fitting case which is attached to the front of the base plate 1 and which has a pair of its upper and lower side plates **6*a* welded to the base plate 1. Moreover, there is formed between the fitting case 6 and the base plate 1 a fitting space 61 which has its lefthand side opened. Indicated at numeral 7 is a front plate portion which is formed by slightly protruding the front of the fitting case to the front and which has its left end portion fixedly adhered at its inner wall to a plate-like rubber magnet 8 and its right end portion formed at its rather upper position with a square aperture 9**.

Indicated at numeral 10 is a locking plate having a large width vertically, as shown in FIG. 2, which is attached to the front side of the base plate 1 and which has its base end caulked together with the aforementioned hook pin 5 to the left end portion of the base plate 1. Here, the caulked portion is covered with the bent portion 2 at the left end of the base plate 1. The locking plate 10 has a spring action and is made so narrower to the right that its leading end extends until to the position where it faces the aperture 9 of the aforementioned fitting case 6. On the other hand, the locking plate 10 has its leading end portion separated to the front from the base plate 1, as shown in FIG. 2, such that it is forced into contact with the inner wall of the front plate portion 7 of the fitting case 6. Indicated at numeral 11 is a retaining portion which is formed at the leading end of the locking plate 10 and which is formed into a stepped shape by bending the leading end of the locking plate at a right angle to the back. Indicated at numeral 12 are pressure portions which are formed by further bending the leading end of the retaining portion 11 at a right angle to the right.

Indicated at numeral 13 is a notch which is formed at the lefthand edge of the fitting case 6. Indicated at numeral 14 is an attaching portion which is formed by protruding the righthand portion of the fitting case 6 to the right and which has its leading end portion formed at its both upper and lower sides with a pair of pins 15 protruding backward. Indicated at numeral 16 is a belt clamper which is hingedly attached between the two pins 15 and which can have its plural teeth 17 clamping one end of the belt 51 together with the back of the aforementioned attaching portion 14. Indicated at numeral 18 is a belt guide slit which is fixedly welded to the back of the belt clamper 16.

Indicated at numeral 31 is a multi-purpose tool which is so formed as a whole into a generally rectangular shape that it can be fitted in the fitting space 61 formed in the buckle. The multi-purpose tool has its righthand portion formed with a cap opener 34, which is composed of an engagement opening 32 and a retaining tongue 33, and its lower righthand corner formed with a can opener 37 which is composed of a blade portion 35 and a retaining protrusion 36. On the other hand, the aforementioned cap opener 34 is formed at its lefthand portion with a spanner portion, which is formed into a hexagonal opening, and at a portion below the spanner portion 38 with a slit 39 which is made to extend in the longitudinal direction. Moreover, the slit 39 has its righthand half formed into three spanner portions 40, which are made smaller than the aforementioned spanner portion 38, and its lefthand half formed into a narrower thumbscrew driver portion 41. Still moreover, the aforementioned multi-purpose tool 31 has its upper edge formed with saw teeth 42, its righthand edge formed with a cutter 43 at a portion excepting the upper end and its upper right corner formed with a slotted head machine screw driver portion 44. An abutment portion 45 is formed between the screw driver portion 44 and the upper end of the aforementioned cutter 43.

Now, FIG. 1 shows the condition in which the multi-purpose tool 31 is taken out of the buckle. When it is intended to fit the multi-purpose tool 31 into the buckle from that condition, the tool 31 is inserted from the side of the cutter 43.

Then, the leading end portion of the same tool 31 is inserted against the attracting force of the rubber magnet 8 and while being pushed to the front by the leading end portion of the locking plate 10. And, when the abutment portion 45 at the leading end of the multi-purpose tool 31 abuts against the stopper 3 at the right end of the base plate 1 until it is stopped, the leading end portion of the locking plate 10 is forced into the engagement opening 32 of the tool 31 which has been shifted to the position where it faces that leading end portion. At this time, since the retaining portion 11 of the locking plate 10 abuts against the right end edge **32*a* of the engagement opening 32 all over the thickness of the multi-purpose tool 31, this tool 31 is so locked that it cannot be extracted to the outside. Since, under this condition, the pressure portion 12 of the locking plate 10 pushes the back of the right end portion of the tool 31 to the front, the same tool 31 is held stably in contact with the back wall of the fitting case 6** without any chatter.

Under this particular condition, on the other hand, the left end portion of the multi-purpose tool 31 is attracted by the rubber magnet 8 at the left end in the fitting case 6.

On the contrary, in case it is intended to take the multi-purpose tool 31 out of the buckle, a finger is inserted through the aperture 9 of the fitting case 6 and through the engagement opening 32 of the tool 31 to inwardly push the locking plate 10. Under the condition in which the retaining portion 11 of the same locking plate 10 is pushed out of the engagement opening 32 to the back, the tool 31 is then pulled out. At this time, the tool 31 is extracted to the outside against the frictional pressure resistance of the locking plate 10 and the attracting force of the rubber magnet 8.

Now, if the leading end of the locking plate 10 is not bent when the tool 31 is attached to and detached from the buckle by the aforementioned procedures, the leading end of the locking plate 10 may go into the space between the fitting case 6 and the tool 31 in case the thickness of that locking plate 10 is made small. If this occurs, the leading end of the locking plate 10 is not disengaged to the back from the engagement opening 32 of the tool 31, even if the locking plate 10 is pushed from the outside with a view to taking the tool 31 out of the buckle, so that the leading end of the locking plate 10 is resultantly bent if the tool 31 is forcibly extracted.

In the buckle according to the present embodiment, however, the locking plate 10 has its leading end formed with the retaining portion 11 which can engage with the inner side of the engagement opening 32 of the tool 31 all over the thickness thereof. As a result, even if the locking plate 10 is made thin, its leading end can be prevented from entering the front side of the multi-purpose tool 31.

Incidentally, since the rubber magnet 8 is used as a magnet for fixing the multi-purpose tool 31 in accordance with the embodiment thus far described, the tool 31 can be prevented from having its front side hurt even if the tool contacts with the magnet when it is attached to or detached from the buckle.

On the other hand, it goes without saying that the attaching and detaching operations of the tool 31 to and from the buckle can be accomplished while the belt 51 is worn.

In the foregoing embodiment, the retaining portion 11 of the locking plate 10 is made to abut against the engagement opening 32 of the multi-purpose tool 31 all over the thickness thereof, and the leading end of the retaining portion 11 is formed with the pressure portions 12. However, these pressure portions 12 can be dispensed with, and the retaining portion 11 itself can be so slightly narrowed that it contacts with a portion of the engagement opening 32 of the tool 31.

A second embodiment of the present invention will be described hereinafter with reference to FIGS. 5 to 8. In the buckle according to this second embodiment, when the locking plate 10 is pushed to the inside of the buckle so as to take the multi-purpose tool 31 out of the buckle, it is pushed not directly with a finger but indirectly through a push lever 19. Specifically, the push lever 19 is formed into a leaf sping shape and is attached to the front plate portion 7 in a manner to cover the aperture 9 from the inside while having its base end fixed to the lefthand portion of the aperture 9. The leading end portion of the same push lever 19 is so made that it is inwardly warped when it is pushed from the outside of the aperture 9. Indicated at numeral 20 is a bent protrusion which is formed by bending the leading end of the push lever 19 to the back and which is positioned just the inside of the relief 4 of the base plate 1, as seen from FIG. 8.

Indicated at numeral 21 are push protrusions which are formed by further bending the leading end of the pressure portions 12 at a right angle to the front and which have their leading ends forced to contact with the back of the push lever 19 just in the vicinity of the lefthand side of the bent portion 20. The push protrusions 21 thus constructed is disposed at a position where it is rightwardly spaced from the cutter 43 of the multi-purpose tool 31 when this tool 31 is fitted in the buckle.

Incidentally, the front plate portion 7 has its both upper and lower sides formed into a pair of abutment portions 7a which are to contact with the front side of the multi-purpose tool 31.

In the second embodiment, the multi-purpose tool 31 is held in contact with the inner sides of the paired upper and lower abutment portions 7a of the fitting case 6 in a stable manner without any chatter.

On the other hand, in case the multi-purpose tool 31 is to be taken out of the buckle, a finger is inserted through the aperture 9 of the fitting case 6 thereby to inwardly push the push lever 19. Then, the push protrusions 21 at the leading end of the locking plate 10 are inwardly pushed, too, by the leading end portion of the same push lever 19. Consequently, the retaining portion 11 of the same locking plate 10 is forced out to the back from the engagement opening 32. As a result, if, under this condition, the tool 31 is pulled out, it can be taken out against the frictional pressure resistance of the locking plate 10 and the attracting force of the rubber magnet 8.

Since the finger inserted into the aperture 9 of the buckle locks and releases the multi-purpose tool 31 through the push lever 19 when the tool 31 is attached to and detached from the buckle, it can be prevented from directing contacting with the tool 31. As a result, the finger can be prevented from touching the cutter 43 at the leading end of the tool 31, when the tool 31 is to be attached to the buckle, and from touching the inner edge of the engagement opening 32 of the tool 31, when the tool 31 is to be extracted from the buckle, so that it can be reliably prevented from being hurt.

Figure 9:
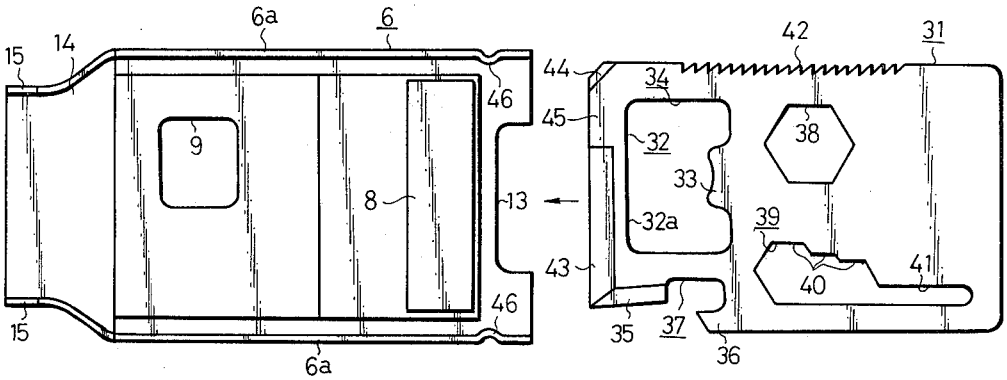
FIG. 9 is a back elevation showing a modification, in which the fitting case is formed at its upper and lower portions with clamping members.
Figure 8:
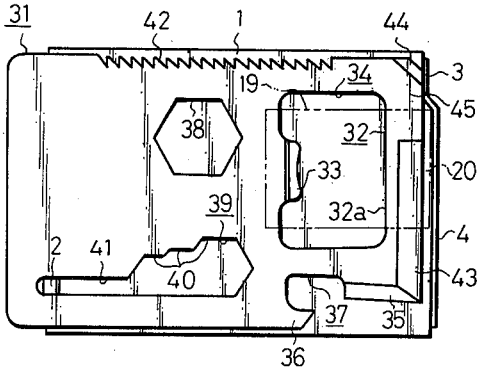
FIG. 8 is a front elevation showing both the engagement condition between the stopper of the buckle of the second embodiment and the abutment portion of the multi-purpose tool and the position of the bent protrusion of a push lever.
Figure 7:
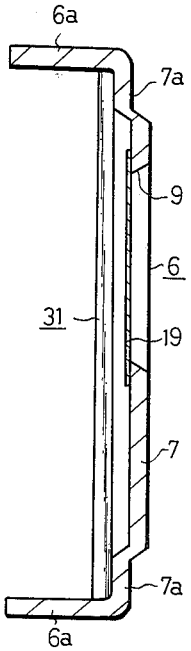
FIG. 7 is an enlarged sectional view showing the condition in which the multi-purpose tool is fitted in a fitting case.
Figure 11:
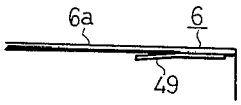
FIGS. 10 and 11 are a partially sectional view and a partial rear elevation showing other modifications of FIG. 9, respectively.
Figure 10:
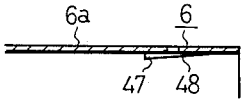

Although, in the aforementioned two embodiments, the multi-purpose tool 31 is held in forced contact with the inner side of the fitting case 6, the tool 31 may be held in the buckle by further clamping the same from the upper and lower sides, as shown in FIGS. 9 to 11.

In a modification shown in FIG. 9, more specifically, the paired upper and lower side plates 6a of the fitting case 6 are partially pushed inwardly in the vicinity of the open end portion of the case 6 thereby to form a pair of clamping protrusions 46, by which the tool 31 can be fixedly clamped from the upper and lower sides.

In a modification shown in FIG. 10, on the other hand, a wedge-shaped clamping member 47 are attached in place of the clamping protrusions 46 to the inner sides of the respective side plates 6a and have their inner sides formed into such taper surfaces 48 as are sloped toward the inside of the buckle. The clamping members 47 are made of plastics or metal.

In a modification shown in FIG. 11, the clamping members 47 of FIG. 10 are replaced by clamping springs 49. These springs 48 are leaf springs made of stainless steel, which have their base ends spot-welded to the side plates 6a of the fitting case 6.

Incidentally, the multi-purpose tool 31 used in the aforementioned two embodiments may have its side at the cutter 43 magnetized at an N polarity and its another side magnetized at an S polarity so that it can be used as a whole as a magnet for indicating a direction. If, in this case, the both right and left sides of the magnet 8 inside of the fitting case 6 are magnetized at the N and S polarities, the both sides of the multi-purpose tool 31 is magnetized each time the tool 31 is fitted in the buckle so that the same tool 31 can be prevented from having its magnetic action naturally weakened.

Figure 12:
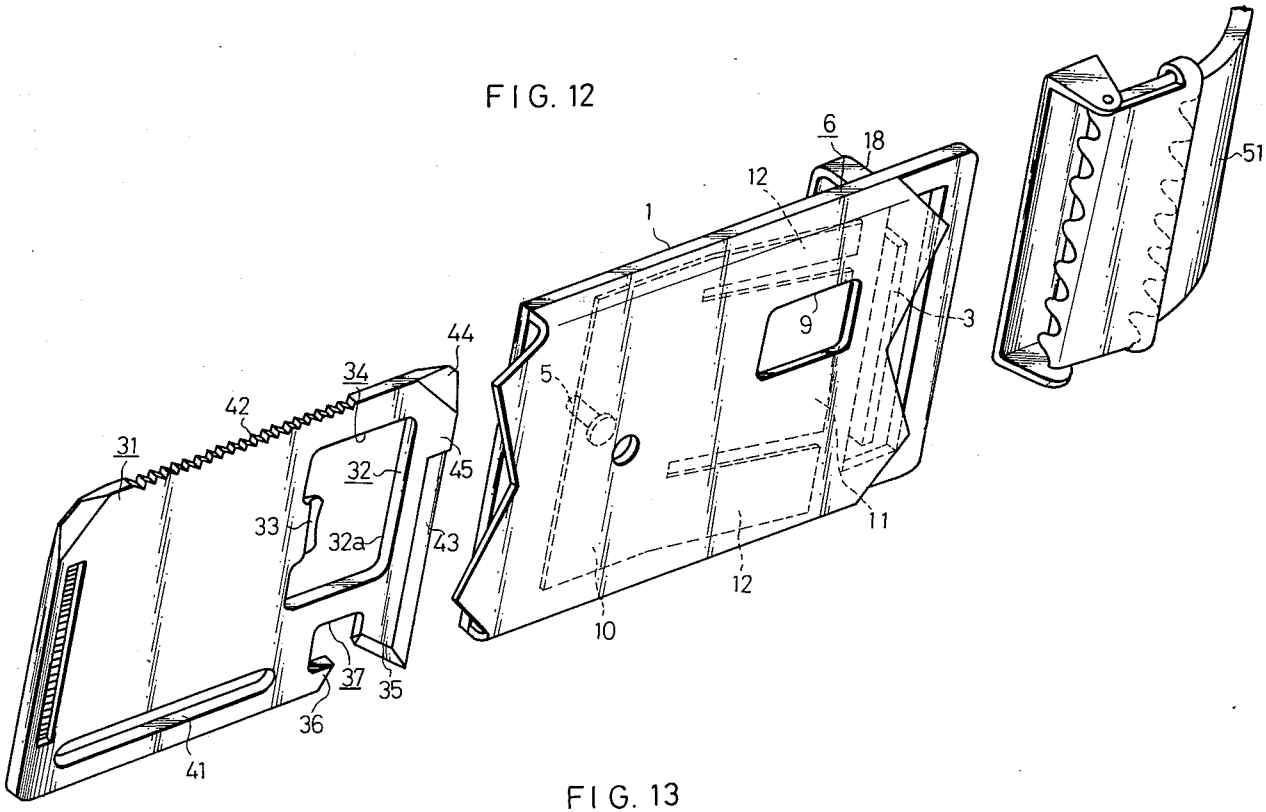
FIG. 12 is a perspective view showing a buckle according to a third embodiment of the present invention.
Figure 13:
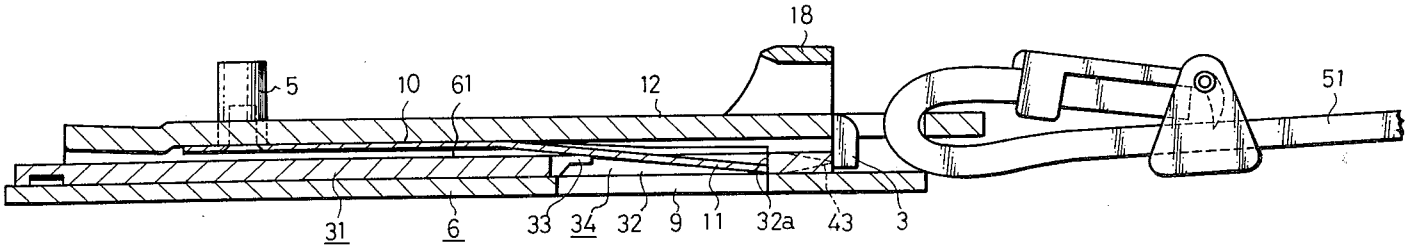
FIG. 13 is an enlarged sectional view showing the multi-purpose tool under the condition in which the tool is fitted in the buckle according to the third embodiment.

A third embodiment of the present invention will be described hereinafter with reference to FIGS. 12 and 13. This third embodiment is especially different from the aforementioned first and second embodiments in that the rubber magnet 8 inside of the fitting case 6 is omitted and in that the shape of the locking plate 10 is modified.

More specifically, the locking plate 10 according to the third embodiment has its base end caulked together with the hook pin 5 to the front side of the base plate 1. The locking plate 10 has its righthand half divided into three upper, intermediate and lower portions. This intermediate portion is formed into the retaining portion 11 which faces the aperture 9 of the buckle, whereas both the upper and lower portions are formed into the pressure portions 12 for pushing the back side of the multi-purpose tool 31.

In the third embodiment under discussion, if the multi-purpose tool 31 is inserted into the buckle, it is forced thereinto while having its back side forced forward by the retaining portion 11 and the pressure portions 12 of the locking plate 10 and its front side forced to contact with the back side of the fitting case 6. And, when the multi-purpose tool 31 has its leading end abutting against the stopper 3 until it is stopped, the retaining portion 11 enters the engagement opening 32 of the tool 31, which has been moved to the position where it faces the retaining portion 11, so that the leading end of the retaining portion 11 abuts against the righthand edge 32a of the same engagement opening 32. Thus, the multi-purpose tool 31 is so locked that it can be extracted to the outside. Since, in the meanwhile, the two pressure portions 12 have been pushing the back side of the tool 31, this tool 31 can be held stably without any chatter inside of the fitting case 6.

When the multi-purpose tool 31 is to be taken out of the fitting tool 6, the finger is inserted through the aperture 9 of the case 6 in a similar manner to those in the case of the aforementioned first and second embodiments thereby to inwardly push the retaining portion 11 so that the tool 31 is extracted under the condition in which the same retaining portion 11 is pushed out of the engagement opening 32.

The stopper 3 according to this third embodiment may be formed by backward bending the righthand portion of the fitting case 6.

Since it is apparent that a variety of different embodiments can be constructed without departing from the spirit and scope of the present invention, the present invention should not be limited to its special modes of embodiment except that it is defined in the appended claims.

What is claimed is:

1. A belt buckle comprising: the combination of a base plate and a case forming a space therebetween; a removable, multi-purpose tool in the shape of a flat plate contained in said space; and a resilient locking member within said space holding said multi-purpose tool in said space between said base plate and said case, said tool forming an opening shaped to allow the engagement of said resilient locking member with said tool, said locking member forming a retaining portion at the free end thereof to extend into said opening and engage said tool to lock said tool in said space between said base plate and said case; and an aperture formed in said case or said base plate and aligned with the retaining portion of said resilient locking member, said aperture being so formed that a finger may be inserted therethrough from the outside to inwardly push the retaining portion of said locking member so that said retaining portion can be disengaged from said tool.

2. A belt buckle according to claim 1, wherein said resilient locking member comprises a leaf spring bent so that its free end extends into said opening in said multi-purpose tool to lock said tool into said space between said case and said base plate.

3. A belt buckle according to claim 1, wherein said resilient locking member comprises a leaf spring and has said retaining portion formed by bending the free end of said leaf spring so that it is in contact with the inner edge of said opening of said multi-purpose tool in its locked condition, across the entire thickness of said tool.

4. A belt buckle according to claim 3, wherein said resilient locking member is further formed by bending an end portion of said retaining portion at a right angle so that said leaf spring urges said tool, in its locked condition, against an inner wall of said space.

5. A belt buckle according to claim 4, wherein said resilient locking member is further formed by bending an end portion of said leaf spring toward said aperture at a right angle; and wherein a push lever comprising a leaf spring attached to the inner wall of said case covers said aperture from the inside and is forwardly spaced from said multi-purpose tool, said push lever having an end portion engaging with said bent end of said leaf spring so that the retaining portion of said spring can be moved to disengage it from said multi-purpose tool by pushing said push lever inwardly.

6. A belt buckle according to claim 1, wherein said multi-purpose tool is formed with an abutment portion at an upper portion of its leading end and with a cutter below said abutment portion; and wherein said base plate has its one end formed, by bending said base plate forward at a right angle, with a stopper which is made engageable with said abutment portion of said multi-purpose tool when said multi-purpose tool occupies said space between said case and said base.

7. A belt buckle according to claim 6, wherein the portion of said stopper, which faces said cutter of said multi-purpose tool, is formed with a relief for preventing itself from contacting said cutter.

8. A belt buckle according to claim 1, wherein said multi-purpose tool is made of metal, and wherein there is mounted in said space a plate-like rubber magnet which is made coactive with said resilient locking member for attracting and holding said tool.

* * * * *